United States Patent [19]

Robb

[11] Patent Number: 4,978,306

[45] Date of Patent: Dec. 18, 1990

[54] SNAP-APART UNIVERSAL JOINTED ELECTRICAL CONNECTION

[76] Inventor: John R. Robb, 7520 Hornwood, Ste. 608, Houston, Tex. 77036

[21] Appl. No.: 421,251

[22] Filed: Oct. 13, 1989

[51] Int. Cl.[5] ..... H01R 35/00

[52] U.S. Cl. ..... 439/8; 439/592

[58] Field of Search ..... 439/6, 8, 592; 174/86; 403/76, 122, 133

[56] References Cited

U.S. PATENT DOCUMENTS

| | | | |
|---|---|---|---|
| 284,805 | 9/1883 | Brewtnall | 439/8 |
| 1,650,014 | 11/1927 | Goldrick | 439/8 |
| 1,953,864 | 4/1934 | Morris | 439/8 |
| 1,957,714 | 5/1934 | Jones | 439/8 |
| 2,007,617 | 7/1935 | Sheward | 439/8 |
| 2,519,933 | 8/1950 | Rouault | 439/8 |
| 2,564,520 | 8/1951 | Blasdell | 439/8 |
| 2,652,546 | 9/1953 | Christner | 439/8 |
| 2,673,965 | 3/1954 | Cass | 439/8 |
| 2,717,792 | 9/1955 | Pelley | 403/76 |
| 2,791,454 | 5/1957 | Saives | 403/122 |
| 2,908,519 | 10/1959 | Holden | 403/122 |
| 3,012,798 | 12/1961 | Berger | 439/8 |
| 3,116,940 | 1/1964 | Jines | 439/8 |
| 3,328,741 | 6/1967 | Brown | 439/737 |
| 3,626,356 | 12/1971 | Trammell | 439/205 |
| 4,544,221 | 10/1985 | Schaller | 439/592 |
| 4,746,297 | 5/1988 | Soleau | 439/8 |

FOREIGN PATENT DOCUMENTS

| | | | |
|---|---|---|---|
| 302012 | 12/1928 | United Kingdom | 439/8 |

*Primary Examiner*—Gary F. Paumen

*Attorney, Agent, or Firm*—Sue Z. Shaper

[57] ABSTRACT

A snap-together universal-jointed electrical connection device comprised of an essentially spherical plug and socket that can rotate and swivel with respect to each other while providing for conducting current through the joint on up to three paths, the plug and/or socket portions being comprised of elastic material that resiliently deforms to permit the plug to be pushed and snapped into, and pulled and snapped out of, the socket.

11 Claims, 2 Drawing Sheets

SNAP-APART UNIVERSAL JOINTED ELECTRICAL CONNECTION

BACKGROUND OF THE INVENTION

1. Field of the Invention

This invention relates to electrical connectors and, more particularly, to electrical connectors of the plug and socket type.

2. Description of the Prior Art

The prior art reveals several approaches to electrical swivel connectors and, more particularly, to universally-jointed electrical connection devices. Some of the prior art relating to universally-jointed electrical connectors only provides for one electric path through the joint. Such is the case with Berger, U.S. Pat. No. 3,012,798; Cass, U.S. Pat. No. 2,673,965; and Blasdell, U.S. Pat. No. 2,564,520. It is an object of the present invention to provide a universally-jointed electrical connection device that will conduct electricity on up to three separate paths.

Some of the prior art of universally-jointed electrical connection devices, in order to make provision for more than one path of electricity specifies the use of more than one spherical plug and socket joint. This is the case with Morris, U.S. Pat. No. 1,953,864, and Soleau, U.S. Pat. No. 4,746,297. It is an object of the present invention to provide for up to three paths of electricity through one joint utilizing one spherical plug located in one spherical socket.

Some of the prior art of universally connected electrical connectors provides for a limitation of the rotation of the plug within the socket such that the permitted rotation is less than 360°. Such is the case with Jines, U.S. Pat. No. 3,116,940, and Brown, U.S. Pat. No. 3,328,741. It is the intent of the present invention to provide for unlimited rotation of the plug within the socket, as well as for significant swivel.

The prior art directed to universally-jointed, fully rotating electrical connector devices that provides for conducting electricity on at least two paths through a single joint, has been found to provide for the use of a plurality of spherical plug elements and/or spherical socket elements within the one joint. This prior art is illustrated by Goldrick, U.S. Pat. No. 1,650,014; Jones, U.S. Pat. No. 1,957,714; Sheward, U.S. Pat. No. 2,007,617; Rouault, U.S. Pat. No. 2,519,933 and Christner, U.S. Pat. No. 2,652,546. In Goldrick, in particular in FIG. 5, it can be seen that the socket is comprised of two spherical shell elements that make contact with two spherical portions of the plug. Likewise, Jones' socket, as illustrated in FIG. 1, is comprised of two spherical shell elements that make contact with two spherical portions of Jones' plug. Also in Sheward, FIG. 2, it can be seen that Sheward's plug is comprised of an interior spherical portion and an exterior hemispherical portion. Sheward's socket offers two concentric spherical portions that relate to the spherical portions of the plug. In Rouault, the spherical plug clearly offers two concentric spherical portions that relate to spherical surfaces of the socket. In Christner, although the socket is comprised of one spherical portion, the plug offers an interior spherical element and an exterior spherical element. It is an object of the present invention to disclose a universally-jointed, fully rotatable electrical connecting device comprised of only one substantially spherical plug and one substantially spherical socket where different portions of those spherical surfaces are utilized to conduct electricity on up to three paths. Such a device achieves a simplicity of design and makes possible the further snap-apart, snap-together feature.

As a further feature, the present invention teaches a "snap-apart and snap-together" electrical connection device. None of the prior art reviewed teaches such a means of connection. In the prior art reviewed, the plug is either designed to be permanently situated within the socket or significant mechanical labor is involved in attaching the plug to the socket and detaching the same. The present invention teaches electrical connectors in which the plug can be easily connected to and disconnected from the socket, substantially independently of the plug's orientation, by a snap-together and snap-apart means, the connectors further providing the features that the plug can rotate fully and freely within the socket and swivel to a significant degree and the connection carries electricity on up to three paths.

The snap-together universally-jointed electrical connection device taught by the present invention is applicable to a wide array of devices, providing a variety of advantages for convenience and comfort. The snap-apart connection provides the advantage of quick and easy connect and disconnect, substantially independent of the orientation of the plug. The snap-apart, snap-together means for connection enjoys a positive mechanical advantage against accidental or partial dislocation. The universal joint in which the plug can rotate fully within the socket and swivel to a significant degree is especially useful in operation with electric service cords. Such a universal joint prevents the cord from becoming twisted and knotted and permits it to diverge at a sharp angle from the socket without undergoing a constant weakening bend.

A further advantage of the snap-apart universally-jointed electrical connector is that the adjustable plug could be directly associated with a light bulb. The direction of light could be adjusted by swiveling and rotating the plug while the snap in and out feature would facilitate the replacement of the bulb. Toys, games, or models could profit from this snap-apart universal connection. The invention makes possible the easy snap-apart and snap-together of a composite of units that can rotate and swivel with respect to each other while at the same time conducting electricity therethrough. The path of the connection of the units to form the composite could be illuminated. Alternately, motorized movement of the parts could be effected.

SUMMARY OF THE INVENTION

This invention relates to a snap-together snap-apart universal-jointed electrical connection device comprised of an essentially spherical plug and an essentially spherical socket. The plug may have one, two, or three conducting portions on its essentially spherical exterior surface. The socket will have a corresponding one, two, or three conducting portions on its essentially spherical interior surface. The socket is dimensioned to closely receive and hold the plug while permitting the plug to rotate and swivel within the socket. While the socket holds the potentially rotating and swiveling plug, portions of the plug's first, second, and/or third conducting surface portions will be held in contact with portions of the socket's first, second, and/or third conducting surface portions, respectively. The plug is connected to an extension portion while the socket has an opening. The extension portion extends out of the opening when the plug is in the socket. The opening of the socket is of lesser area than a great circle area of the plug. At least portions of the socket around the opening, or at least portions of the plug, or at least portions of both, are comprised of elastic material such that the material resiliently deforms to permit the plug to be pushed to snap into, and pulled to snap out of, the socket. Conducting means exist within the plug and the socket to conduct current from each surface conducting portion through and out of the plug and the socket.

DETAILED DESCRIPTION OF THE PREFERRED EMBODIMENT

For convenience, an axis system will be defined through the plug and the socket in order to better describe the invention. A line roughly centered through the plug's extension portion and through the middle of the essentially spherical plug defines the plug's longitudinal axis 70. A line roughly centered through the essentially spherical interior space of the socket and through the middle of the socket's opening defines the socket's longitudinal axis 60. When the plug is in the socket and extension portion E is centered in opening 0, illustrated in FIG. 1, the two longitudinal axes will roughly coincide. Turning of the plug or the socket around its longitudinal axis will be called rotation. When the plug is in the socket, the angular deviation of the plug's longitudinal axis from the socket's longitudinal axis will be referred to as swivel. By this definition, the plug has two degrees of freedom within which to swivel with respect to the socket. Of course, such motion could equally be referred to as the swivel of the socket with respect to the plug.

Figure 1:
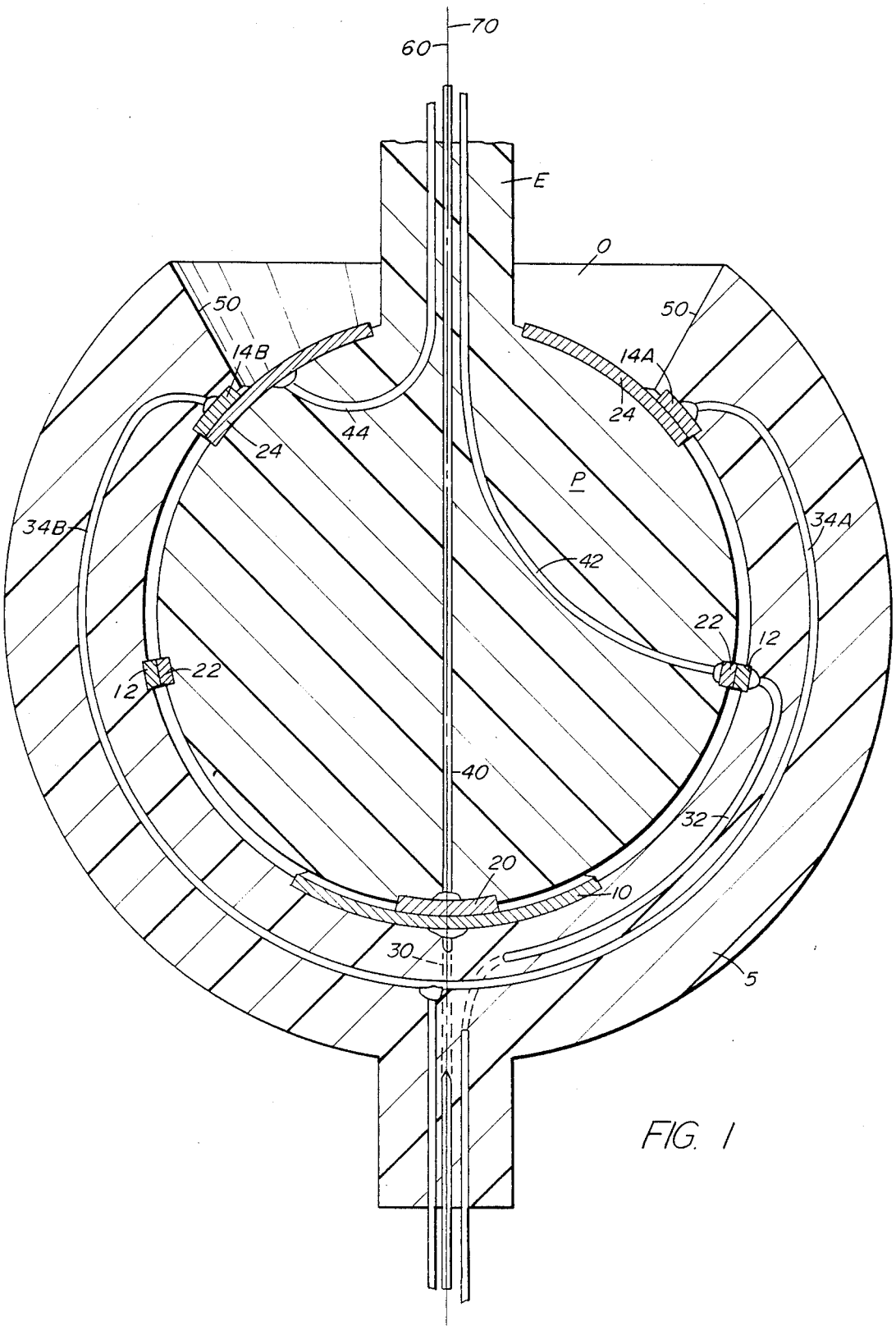
FIG. 1 is a sectional view of a preferred embodiment of the present invention with the plug inside the socket, the plug and socket providing for three conducting paths.

FIG. 1 illustrates a sectional view of a preferred embodiment of the present invention. In FIG. 1, both the plug and the socket are shown with three surface conducting portions. The plug is shown aligned in the socket so that the plug longitudinal axis 70 and the socket longitudinal axis 60 roughly coincide. It can be seen that in this configuration, the conducting exterior surface portions of the plug are roughly aligned with the conducting interior surface portions of the socket.

Figure 2:
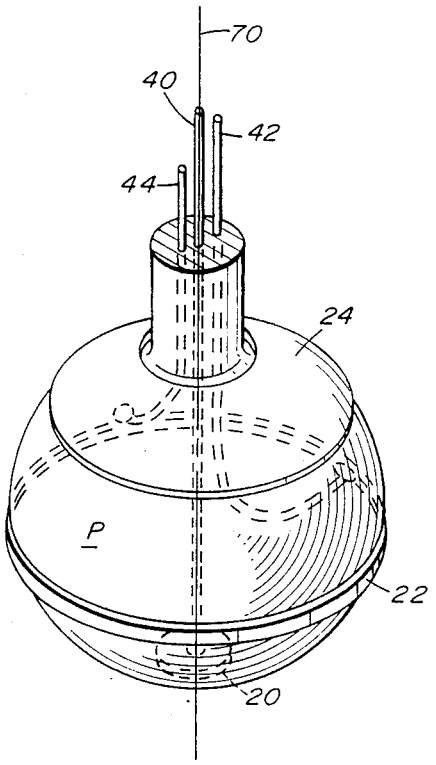
FIGS. 2 and 3 provide elevational views of the plug and socket of FIG. 1, respectively, with hidden features indicated by dashed lines.
Figure 3:
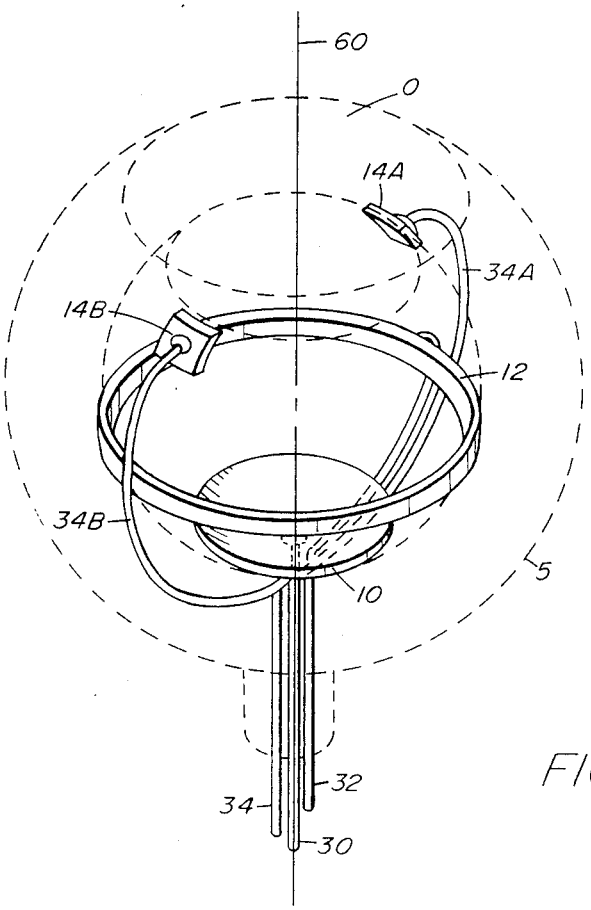

It can be appreciated from the depiction of the preferred embodiment in FIGS. 1, 2, and 3 that the plug can rotate freely with respect to the socket and swivel up to thirty degrees with respect to the socket while the first, second, and third conducting portions of the socket maintain electrical contact solely with the first, second, and third conduction portions of the plug, respectively.

In FIG. 1, essentially spherical plug P, connected to extension portion E, is fully snapped into, received, and held by essentially spherical socket S. The space 52 between plug P and socket S has been exaggerated in the drawings for clarity. In operation, the respective conducting portions of the plug and the socket will be held in close contact. Such conducting portions might be raised, in fact, from the general surface of the plug or socket to aid in maintaining that contact. Alternately, the respective conductor portions might also be biased outwardly on the plug and inwardly on the socket to help maintain that contact.

In the preferred embodiment illustrated in FIG. 1, plug P has a first surface conducting portion 20, a second surface conducting portion 22, and a third surface conducting portion 24. Plug first surface conducting portion 20 is a small disk shaped piece centered around the plug longitudinal axis at the portion of the plug away from the extension portion. Surface conducting portion 20 is shown extending approximately 10° around all sides of the longitudinal axis when degrees are measured from the center of the plug. Wire 40 extending through the plug and to conducting portion 20 serves to conduct current through extension E, through plug P, and to the first conducting surface. First surface conducting portion 10 of the socket is a circular piece conforming to the interior essentially spherical surface of the socket, located in the lower portion of the socket away from the socket opening 0, and centered around the socket longitudinal axis. Conducting portion 10 extends for approximately 30° on all sides of the socket longitudinal axis when degrees are measured from the center of the interior space of the socket. Wire 30 extends through socket S to conductive portion 10.

As can be readily seen, this preferred embodiment is designed to permit the plug to swivel approximately 30° around the socket's longitudinal axis. The degree of swivel of the plug is limited by the extension portion E striking the side 50 of the socket opening 0. The plug has unlimited freedom to rotate around its longitudinal axis while within the socket. It can be seen from inspection of FIG. 1 and the dimensions therein illustrated that if the plug rotates around the longitudinal axis or swivels 30° within the socket that at least approximately half of the plug's first conducting surface portion 20 will be in contact with some portion of the socket's first conducting portion 10.

In the preferred embodiment illustrated in FIG. 1, plug P has a second surface conducting portion 22. As FIG. 2 indicates, conduction portion 22 is a band encircling the plug. The band describes less than a great circle of the essentially spherical plug. If a plug's "equator" were drawn as a great circle perpendicular to the plug's longitudinal axis, band 22 would lie on a lesser circle through the plug, or on a line of "latitude," so to speak, that is approximately parallel to the plug's equator but 10° removed toward the "pole" or extremity of the plug that is away from extension portion E. Band 22 is illustrated as being approximately 5° wide. Wire 42 serves as a means for conducting current to and from band 22, wire 42 extending from band 22 through plug P and through extension E. Socket S is illustrated with a second surface conducting portion 12, being a band approximately 5° wide extending around the interior surface portion of the socket and located to approximately overlay band 22 of the plug when the plug and socket are aligned along their longitudinal axes. FIG. 3 illustrates the band nature of socket conducting portion 22. Wire 32 serves as a means of conducting current to and from band 12 through socket S. It can be seen that if the plug rotates 360° within the socket, or swivels up to 30° with respect to the socket's longitudinal axis, portions of second plug conducting surface 22 will always be in contact with portions of second socket conducting surface portion 12.

In the Figures, plug P is illustrated as having a third conducting surface portion 24. Portion 24 is a wide band situated near the top or extension end of the plug and centered around the longitudinal axis. Plug conducting surface portion 24 is shown approximately 40° wide and extending from approximately 55° away from the longitudinal axis, as measured from the plug's extension end, to approximately 15° away from that axis. Extension E is centered within that band. Wire 44 serves as a means for conducting current to and from band 24, wire 44 extending through plug P and through extension E. Socket S is illustrated with third surface conducting portions 14*a* and 14*b*. Portions 14*a* and 14*b* are illustrated as roughly square pieces located diametrically opposite each other and molded to fit around the interior essentially spherical surface of the socket. The portions are shown roughly 10° on a side. Wires 34*a* and 34*b*, that combine into wire 34, serve as a means for conducting current to and from surface conducting portions 14*a* and 14*b* through socket S. It can be seen that if the plug rotates 360° within the socket or swivels up to 30° with respect to the socket's longitudinal axis, that portions of third plug conducting surface 24 will always be in contact with portions of at least one or the other of socket conducting surface portions 14*a* or 14*b*.

Extension portion E attached to spherical plug P is dimensioned with respect to opening 50 of the socket to permit a swivel of the plug within the socket of approximately 30° on each side of socket longitudinal axis, as above mentioned. In the preferred embodiment illustrated, it can be seen that the diameter of the opening is approximately ¾ths of the diameter of the plug. With such dimensions, the plug and socket should be able to swivel 30°, rotate without limitation, and conduct electricity therethrough on three separate paths. If the utilization for the device requires only a first conducting portion on the surface of the plug and a first conducting portion on the surface of the socket, the dimensions of the plug and socket can be altered to permit a greater degree of swivel. However, the size of opening 50 of the socket generally cannot exceed, or approach too closely, the size of the diameter of the plug in order to ensure that the socket receives and holds the plug securely when the plug is snapped in.

If only one conducting portion is required on the surface of the plug and the socket, as mentioned above, then the first conducting portions 20 and 10, illustrated in the figures, would be the conducting portions most naturally utilized. The other conducting portions of the plug and the socket, 22 and 12 and 24 and 14, together with their wires or conducting means, could be omitted. Likewise, if only a first and second conducting portion on the surface of the plug and the socket were required, the first and second surface conducting portions illustrated by items 10 and 20 and 12 and 22 preferably would be utilized. Of course, if only one conducting path through the plug and socket were required, virtually the entire plug and some portion of the interior socket surfaces could be conducting.

Except for the conducting portions on the interior surface of the essentially spherical socket, and the related conducting means, the socket should be constructed of an electrically insulating, heat resistant material. Similarly, the plug should be constructed of an electrically insulating, heat resistant material, save for the conducting surface portions on the plug and the conducting means through the plug. Portions comprising and around opening 50 of the socket may be comprised of a resilient elastic material that expands to permit a plug to be snapped into, or snapped out of, the socket. Alternately, the plug may be comprised of a resilient elastic material that permits the plug to deform and snap into when pushed, and pull out of when pulled, a socket. Alternately again, both the plug and either portions or all of the socket can be comprised of a resilient elastic material such that both the opening expands and the plug deforms as the plug is snapped into and out of the socket. In the preferred embodiment, a thermosetting polymer, and in particular a silicon thermosetting polymer, is the preferred material for the construction of both the plug and socket, save for their conducting portions, which may be metal. Such material combines electrically insulating, heat resistant properties with the necessary elasticity to resiliently expand and deform.

In one embodiment, the extension portion E of the plug might connect immediately to, or become a holder for, a light bulb. In another embodiment, extension E might also connect to or become a standard socket for a two-pronged electrical plug. The socket could also provide a means for a connection to a standard two-pronged socket. In these cases, the conducting means or wires as shown in the preferred embodiment would be connected appropriately.

The term "great circle," as used in the claims, is used in the sense in which it is defined in Webster's dictionary—a circle formed on the surface of a sphere by the intersection of a plane that passes through the center of the sphere. A great circle area of a spherical element, such as the plug, would be the area defined by a great circle through that spherical element, or the plug.

From the foregoing, it will be apparent that there has been provided an improved system for electrical connectors and, more particularly, snap-apart universal-jointed electrical connectors. Various changes or alterations may be made in this system without departing from the spirit of this invention. The changes are contemplated by the claims and are within their scope and these claims define the present invention. Additionally, the present invention is intended to be taken as an illustration of this invention.

What is claimed is:

1. A snap-together universal-jointed electrical connection device, comprising:

an essentially spherical plug having a first conducting portion on its external surface, the plug being connected to an extension portion;

a first plug electrical conductor disposed internally of said plug and electrically connected to said first conducting portion, said conductor extending from said plug through said extension portion;

an essentially spherical socket having a first conducting portion on its interior surface, the socket dimensioned to closely receive and hold the plug while permitting the plug to rotate and swivel within the socket, the socket holding the plug such that a portion of the plug's first conducting surface is in contact with a portion of the socket's first conducting surface;

the socket having an opening of lesser area than a great circle area of the plug, portions of the socket around said opening being comprised of elastic material that resiliently deforms to permit the plug to be pushed into and pulled out of the socket, said resiliency assuring that the portions of the socket reassume the original shape wherein the socket closely receives and holds the plug when the plug is within the socket, and said plug extension portion extending out of the opening when the plug is in the socket.

2. A snap-together universal-jointed electrical connection device, comprising:

an essentially spherical plug having a first conducting portion on its external surface, the plug being connected to an extension portion;

a first plug electrical conductor disposed internally of said plug and electrically connected to said first conducting portion, said conductor extending from said plug through said extension portion;

an essentially spherical socket having a first conducting portion on its interior surface, the socket dimensioned to closely receive and hold the plug while permitting the plug to rotate and swivel within the socket, the socket holding the plug such that a portion of the plug's first conducting surface is in contact with a portion of the socket's first conducting surface;

the socket having an opening of lesser area than a great circle area of the plug, the plug being comprised of elastic material that resiliently deforms to permit the plug to be pushed into and pulled out of the socket through the opening, said resiliency assuring that the plug reassumes the original shape wherein the socket closely receives and holds the plug when the plug is within the socket, and said plug extension portion extending out of the opening when the plug is in the socket.

3. A snap-apart universal-jointed electrical connection device, comprising:

an essentially spherical plug having a first conducting portion on its external surface, the plug being connected to an extension portion;

a first plug electrical conductor disposed internally of said plug and electrically connected to said first conducting portion, said conductor extending from said plug through said extension portion;

an essentially spherical socket having at least a first conducting portion on its interior surface, the socket dimensioned to closely receive and hold the plug while permitting the plug to rotate and swivel within the socket, the socket holding the plug which that a portion of the plug's first conducting surface is in contact with a portion of the socket's first conducting surface;

the socket having an opening of lesser area than a great circle area of the plug, portions of the socket around said opening and of the plug being comprised of elastic material that resiliently deforms to permit the plug to be pushed into and pulled out of the socket through the opening, said resiliency assuring that the portions of the socket and plug reassume the original shape wherein the socket closely receives and holds the plug when the plug is within the socket, and said plug extension portion extending out of the opening when the plug is in the socket.

4. The device of claims 1, 2, or 3, wherein the plug has a second conducting portion on its exterior surface, the socket has a second conducting portion on its interior surface, the socket holds the plug such that a portion of the plug's second conducting surface is in contact with a portion of the socket's second conducting surface, and said plug further includes a second plug electrical conductor disposed internally of said plug and electrically connected to said second plug conducting portion, said conductor extending from said plug through said extension portion.

5. The device of claim 4 wherein the plug has a third conducting portion on its exterior surface, the socket has a third conducting portion on its interior surface, the socket holds the plug such that a portion of the plug's third conducting surface is in contact with the portion of the socket's third conducting surface, and said plug further includes a third plug electrical conductor disposed internally of said plug and electrical conductor disposed internally of said plug and electrically connected to said third plug conducting portion, said conductor extending from said plug through said extension portion.

6. The device of claims 1, 2, or 3, wherein the plug rotates for at least 360° and swivels for at least 30° within the socket.

7. The device of claim 4, wherein the plug rotates for at least 360° and swivels for at least 30° within the socket.

8. The device of claim 5, wherein the plug rotates for at least 360° and swivels for at least 30° within the socket.

9. The device of claim 3, wherein the plug and socket are comprised of a thermosetting polymer.

10. The device of claim 9, wherein the thermosetting polymer is a silicon.

11. The device of claim 5, wherein the first plug conducting portion comprises a circular piece conforming to the exterior surface of the plug, located opposite the extension portion and subtending an interior angle of approximately 20° as measured from the center of the plug;

the second plug conducting portion comprises a band-like piece extending around and conforming to the exterior surface of the plug, the width of the band subtending an interior angle of approximately 5° as measured from the center of the plug, the band piece defining within it, at its maximum diameter, a circle that is less than a great circle of the plug;

the third plug conducting portion comprises a band-like piece extending around and conforming to the exterior surface of the plug and encircling the connection of the plug with the extension portion, the width of the band subtending an interior angle of approximately 40° as measured from the center of the plug, the band piece defining within it at its maximum diameter a circle that is less than a great circle of the plug;

the first socket conducting portion comprising a circular piece conforming to the interior spherical surface of the socket, located opposite the opening and subtending an interior angle of approximately 60° as measured from the center of the socket interior space;

the second socket conducting portion comprises a band-like piece extending around and conforming to the spherical interior surface of the socket, the width of the band subtending an interior angle of approximately 5° as measured from the center of the interior space of the socket, the band piece defining within it at its maximum diameter a circle that is less than a great circle of the interior space of the socket; and the third socket conducting portion comprises at least two pieces conforming to the spherical interior surface of the socket, located proximate the opening of the socket, the width and breadth of each piece subtending interior angles of approximately 10° as measured from the center of the interior space of the socket.

* * * * *